US011788729B2

(12) United States Patent
Cowan

(10) Patent No.: US 11,788,729 B2
(45) Date of Patent: Oct. 17, 2023

(54) COOKING APPLIANCE WITH INTEGRATED TOUCH SENSING CONTROLS

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 392 days.

(21) Appl. No.: 17/094,074

(22) Filed: Nov. 10, 2020

(65) Prior Publication Data

US 2022/0146105 A1 May 12, 2022

(51) Int. Cl.
*F24C 3/12* (2006.01)

(52) U.S. Cl.
CPC ..... *F24C 3/126* (2013.01); *F24C 3/124* (2013.01)

(58) Field of Classification Search
CPC ..... F24C 3/126; F24C 3/124
USPC ..... 126/39 BA
See application file for complete search history.

(56) References Cited

U.S. PATENT DOCUMENTS 7,428,901 B2 9/2008 Gama et al.
7,527,072 B2 5/2009 Crnkovich
9,709,284 B2 7/2017 Bach et al.
2010/0253653 A1 10/2010 Stambaugh et al.
2011/0100353 A1* 5/2011 Rauth ..... H03K 17/96 126/39 BA
2011/0148773 A1* 6/2011 Rudolph ..... H03K 17/96 345/173
2012/0256845 A1* 10/2012 Noble ..... G06F 3/04186 345/173
2012/0285243 A1 11/2012 Yamamoto
2013/0260320 A1 10/2013 Townsend
2014/0001173 A1 1/2014 Holzgreve
2015/0193073 A1 7/2015 Dmytriw et al.
2016/0063837 A1* 3/2016 Shao ..... G08B 21/0484 340/540
2017/0238751 A1 8/2017 Vengroff
2017/0364197 A1* 12/2017 Yang ..... G06F 3/0362
2020/0011534 A1 1/2020 Park et al.

FOREIGN PATENT DOCUMENTS

CA 2868792 A1 * 10/2013 ..... F24C 3/12

* cited by examiner

*Primary Examiner* — Avinash A Savani
(74) *Attorney, Agent, or Firm* — Gray Ice Higdon

(57) ABSTRACT

A system and apparatus utilize integrated touch sensing controls to operate a cooking appliance. Among other benefits, one or more touch sensors integrated on control knobs may be used in combination with one or more position sensors and/or one or more ignition detectors to detect and signal an alert in response to different operating scenarios of the cooking appliance, to enable energization of the cooking appliance, and/or to activate/deactivate a control lock feature.

24 Claims, 6 Drawing Sheets

COOKING APPLIANCE WITH INTEGRATED TOUCH SENSING CONTROLS

BACKGROUND

Appliances such as cooktops or ranges have a variety of control or selector knobs for adjusting and controlling the amount of heat supplied to various appliance burners or cooking elements. For burners that rely on electric power, turning a control knob generally energizes an associated burner and causes the burner to generate heat. For burners that rely on gas power, turning a control knob generally causes a gas valve to be opened to supply gas to the burner, and a separate ignitor is triggered to ignite the gas to generate heat. One concern that arises with cooktops and ranges is the risk of unintentional energization of a burner and/or unrestricted gas flow from a burner (e.g., where a control knob is turned and left in an "on" position but no ignition was successfully completed). Typical burners may be unintentionally energized, for example, by the user, a pet, and/or someone not aware that they bumped into or otherwise turned the associated control knob. This may occur even though typical burners usually include a two-manual-operation protocol to energize a burner (e.g., pushing and turning of the corresponding control knob). Also, these knobs are easily accessible to the average user, thereby making them simple and quick to operate, but also providing ready access to children and others lacking the requisite judgment to operate cooking appliances. Meanwhile, it could be difficult for users to tell whether a burner is lit or not sometime during the ignition process, especially for manual gas systems.

Thus, there is a need to reduce the inadvertent operation (e.g. on, off, open, close, etc.) of appliance controls/valves, or portions thereof, as well as to alert the user(s) or people in the surrounding area of the fact that one or more cooking elements have been activated or energized (whether e.g., unintentionally and/or intentionally).

SUMMARY

The herein-described embodiments address these and other problems associated with the art by utilizing integrated touch sensing controls for cooking appliances. Among other benefits, one or more touch sensors integrated on control knobs in accordance with some embodiments may be used in combination with one or more position sensors (e.g., encoders) and/or one or more ignition detectors (e.g., flame sensors) to detect and signal an alert in response to different operating scenarios of the cooking appliance, to enable energization of the cooking element, and/or to activate/deactivate a control lock feature. For example, in some embodiments, the disclosed system and apparatus may generate an alert to indicate a burner has been ignited while the user is still touching a corresponding control knob. Additionally, the disclosed system and apparatus may also signal to the user that the burner has not been ignited while the user has released the corresponding control knob in an open position.

Therefore, consistent with one aspect of the disclosure, in some embodiments, a cooking appliance may include a cooking element, a user control configured to control an output level of the cooking element through movement of the user control within a range of positions, a touch sensor disposed on the user control and configured to detect a user touching status of the user control, a position sensor configured to detect a position status of the user control within the range of positions, and a controller coupled to the touch sensor and the position sensor and configured to selectively generate an alert for a user in response to the user touching status detected by the touch sensor and the position status detected by the position sensor.

In some embodiments, the controller is further configured to generate the alert in response to determining that the user touching status indicates that the user control is not currently being touched by the user and that the position status indicates that the user control has moved to an energized position within the range of the positions. Moreover, the controller is further configured to disable energization of the cooking element in response to determining that the user touching status indicates that the user control is not currently being touched by the user and that the position status indicates that the user control has moved to the energized position within the range of the positions.

In some embodiments, the touch sensor is a first touch sensor and the user touching status is a first user touching status. The cooking appliance further includes a second touch sensor disposed on the user control and configured to detect a second user touching status of the user control, and the controller is further coupled to the second touch sensor and is configured to generate the alert in response to determining that the position status indicates that the user control has moved to an energized position within the range of the positions without both of the first and second user touching statuses indicating that the user control is currently being touched by the user.

In some embodiments, the controller is further configured to enable energization of the cooking element in response to detecting a multi-tap gesture by the user from the user touching status. Moreover, the controller determines the multi-tap gesture by the user from the user touching status by detecting multiple user touches on the touch sensor within a predetermined period of time, and the controller is further configured to generate the alert in response to determining that the position status indicates that the user control has moved to an energized position within the range of the positions without detecting the multi-tap gesture by the user from the user touching status.

In some embodiments, a gas cooking appliance may include a gas cooking element, a user control configured to control an output level of the gas cooking element through movement of the user control within a range of positions, a touch sensor disposed on the user control and configured to detect a user touching status of the user control, an ignition detector configured to detect an ignition status of the gas cooking element, a position sensor configured to detect a position status of the user control within the range of positions, and a controller coupled to the touch sensor, the ignition detector, and the position sensor and configured to selectively generate an alert for a user in response to the user touching status detected by the touch sensor, the ignition status detected by the ignition detector, and the position status detected by the position sensor.

In some embodiments, the controller is configured to generate the alert in response to determining that the user touching status indicates that the user control is currently being touched by the user and that the ignition status indicates that the gas cooking element is currently lit. In some other embodiments, the controller is configured to generate the alert in response to determining that the user touching status indicates that the user control is not currently being touched by the user, that the ignition status indicates that the gas cooking element is not currently lit, and that the position status indicates that the user control is in a position in which gas is currently flowing to the gas cooking element.

In some embodiments, a cooking appliance may include a plurality of cooking elements, a plurality of user controls configured to control output levels of the plurality of cooking elements, each of which having a touch sensor disposed thereon and configured to detect a user touching status therefor, and a controller coupled to the touch sensor of each of the plurality of user controls and configured to activate and/or deactivate a control lock function in response to determining that the user touching statuses of the touch sensors of at least two of the plurality of user controls indicate that the at least two of the plurality of user controls are currently being touched by a user. Moreover, the controller is configured to activate and/or deactivate the control lock function only if at least two of the plurality of user controls are currently being touched by a user for a predetermined period of time.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

These and other advantages and features, which characterize the disclosure, are set forth in the claims annexed hereto and forming a further part hereof. However, for a better understanding of the disclosure, and of the advantages and objectives attained through its use, reference should be made to the Drawings, and to the accompanying descriptive matter, in which there is described example embodiments of the disclosure. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein.

DETAILED DESCRIPTION

The embodiments discussed hereinafter will focus on the implementation of the hereinafter-described techniques and apparatuses within a residential type cooking appliance such as a cooking appliance 10 as described below, such as the type that may be used in single-family or multi-family dwellings, or in other similar applications. However, it will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within gas/electric top burners, gas/electric ranges, slide-in ovens, freestanding ovens, gas/electric cooktops, gas/electric countertop ranges, etc. using a gas/electric burner or cooking surface would be well within the abilities of one of ordinary skill in the art having the benefit of the instant disclosure, so the embodiments are not limited to the residential-type range implementation discussed further herein.

Figure 1:
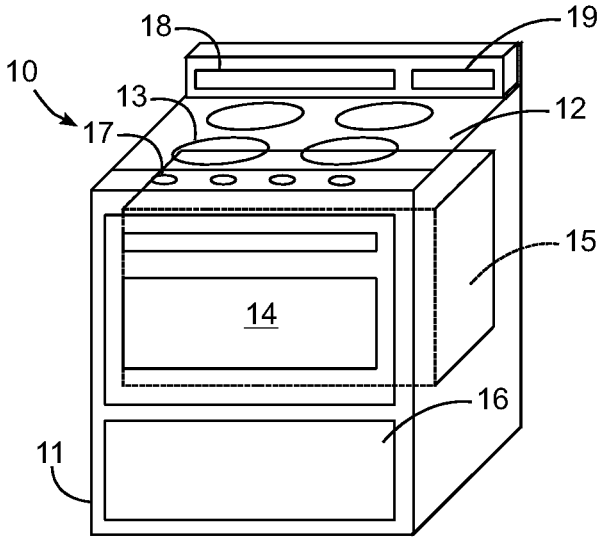
FIG. 1 is a perspective view of a cooking appliance, in accordance with various embodiments.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 11, a stovetop or cooktop 12 including a plurality of burners 13, and an oven 14 defining an oven or cooking cavity 15 accessed via an oven door. Cooking appliance 10 may also include a storage drawer 16 in some embodiments, or in other embodiments, may include a second oven. Various cooking elements (not shown in FIG. 1) may also be incorporated into cooking appliance 10 for cooking food in oven 14, e.g., one or more electric or gas heating elements. In some embodiments, cooktop 12 may include one or more cooking grates (not shown) thereon. The cooking grate may support a cooking vessel or cookware (not shown) over burner 13.

Cooking appliance 10 may also include various user interface devices, including, for example, control knobs 17 for controlling burners 13, a control panel 18 for controlling oven 14 and/or burner 13, and a display 19 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 19 may be touch sensitive to receive user input in addition to displaying status information and/or otherwise interacting with a user. In other embodiments, cooking appliance 10 may be controllable remotely, e.g., via a smartphone, tablet, personal digital assistant or other networked computing device, e.g., using a web interface or a dedicated app.

Display 19 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 may be a range, which combines both a stovetop and one or more ovens, and which in some embodiments may be a standalone or drop-in type of range. In other embodiments, however, cooking appliance 10 may be another type of cooking appliance, e.g., a cooktop without a separate oven. In general, a cooking appliance consistent with the disclosure may be considered to include any residential-type appliance including a housing and one or more cooking elements disposed therein and configured to generate energy for cooking food on a cooktop and/or within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments.

Figure 2:
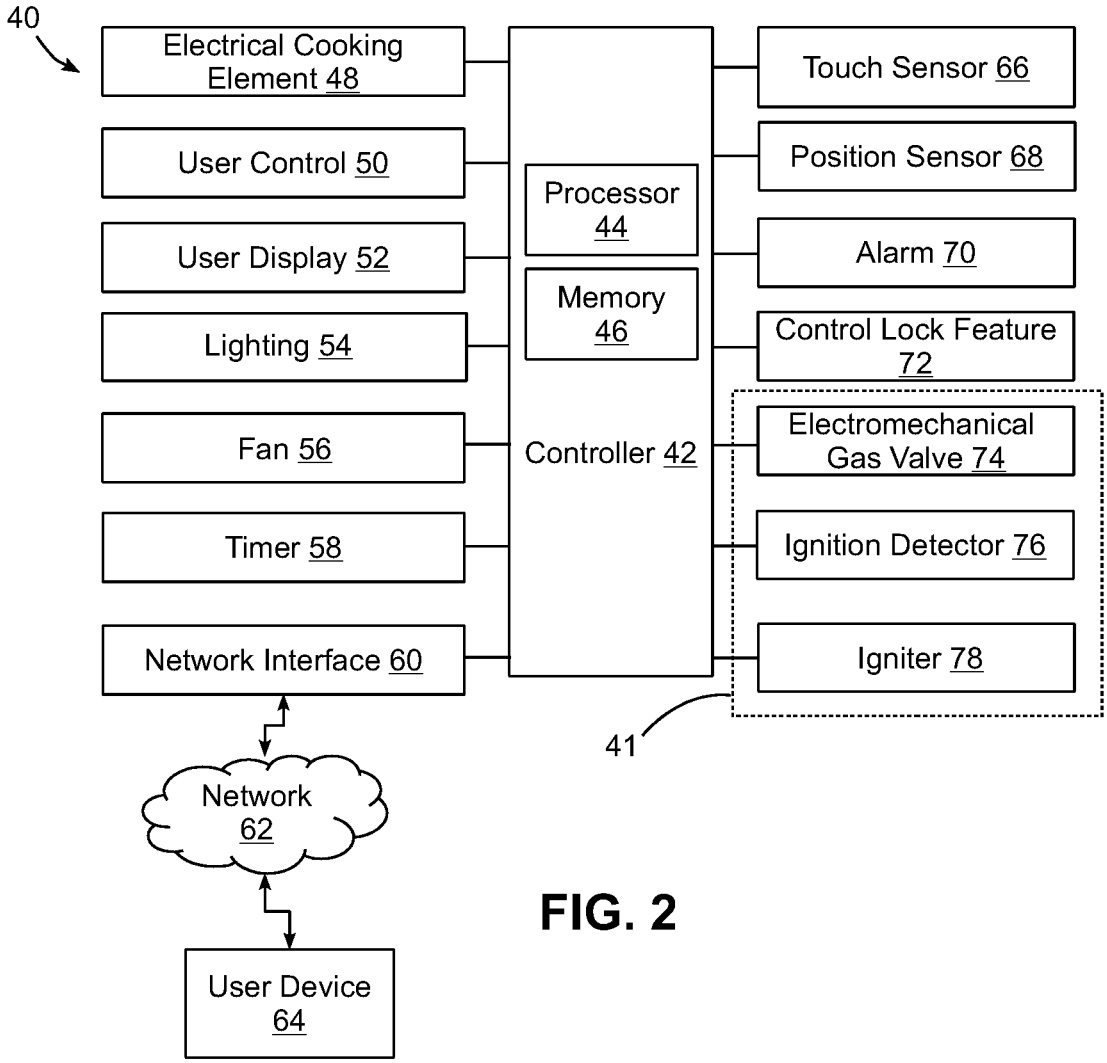
FIG. 2 is a block diagram of an example control system for a cooking appliance, in accordance with various embodiments.

A cooking appliance consistent with the disclosure also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42. The processor 44 may be any hardware device capable of executing instructions stored in memory 46 or otherwise processing data. As such, the processor may include a microprocessor, field programmable gate array (FPGA), application-specific integrated circuit (ASIC), or other similar devices. The memory 46 may include various memories such as, for example L1, L2, or L3 cache or system memory. As such, the memory 46 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

As shown in FIG. 2, controller 42 may be interfaced with various components, including one or more electrical cooking elements 48 used for cooking food, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others. It will be appreciated that cooking element 48 coupled directly to controller 42 here may be any type of electrical cooking element. In some other embodiments without direct controller connection, the various combinations of gas, electric, inductive, light, microwave, light cooking elements may be used. It will also be appreciated that an energized position for use control 50 may cover any user control positions during the movement/change of user control 50 (i.e., not only the user control positions when cooking element 48 is energized).

In some embodiments, controller 42 may set a timer 58 to track a time span or a predetermined period of time. The predetermined period of time may be a variety of amounts and/or be defined by the user in various embodiments. For example, when a first user input or manual operation (e.g., user touch) is detected, the controller 42 may be configured to start the timer 58, and to determine whether a second user input is provided by the user or not, within the predetermined period of time based upon the current value of timer 58 and when the first user input is received.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. For example, network interface 60 may include a network interface card (NIC) configured to communicate according to the Ethernet protocol. Additionally, network interfaces 60 may implement a TCP/IP stack for communication according to the TCP/IP protocols. Various alternative or additional hardware or configurations for network interface 60 will be apparent to one of ordinary skill in the art.

In some embodiments, cooking appliance 40 may include one or more touch sensors 66 that may provide touch statuses as user input to controller 42. In some embodiments, touch sensor 66 may be any touch element such as a capacitive touch sensor, a mechanical, an electrical, or an electro-mechanical switch (e.g., a momentary switch). In some embodiments, touch sensor 66 may be a programmed button or selection on operator interface (e.g., user display 52) such that a user must select or touch the user interface in the prescribed method to activate. In some additional embodiments, touch sensor 66 may be integrated into user control 50, such that pressing on user control 50 itself may activate touch sensor 66. In such a manner, controller 42 may be configured to recognize an operation of user control 50 as intentional through detecting a touch status by touch sensor 66 on user control 50. In some other embodiments, a plurality of touch sensors 66 on user control 50 may be used to detect touch status simultaneously to recognize an operation of user control 50 as intentional.

In some embodiments, one or more position sensors 68 may be coupled to controller 42 to detect position statuses of user control 50. In some embodiments, user control 50 may be mounted to or secured to position sensor 68 such as an encoder, potentiometer, or equivalent signal generator that provides and is operatively coupled to controller 42 representative of the position of user control 50 when user control 50 is moved. In some embodiments, position sensor 68 may be one or more position switches that sense whether user control 50 is at a certain position and/or within a certain range instead of sensing the exact angular position of user control 50 like an encoder. For example, a cam system may engage position sensor 68 to signal the position status whenever the user control 50 is within an energized range.

In some embodiments, besides touch sensor 66 and/or position sensor 68, controller 42 may also be interfaced with various other sensors (not shown) to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. For example, cooking appliance 40 may include one or more temperature sensors for sensing an air temperature within an oven cavity.

In some embodiments, controller 42 may be interfaced with one or more alarms 70 to signal an alert regarding various conditions of cooking appliance 40 (e.g., energization/de-energization conditions inside of and/or external to cooking appliance 40). For example, alarm 70 may alert or communicate to the user and/or a device concurrently with a cooking element has been energized (e.g., unintentionally and/or intentionally activated from off position to on position). Alarm 70 may be a variety of signals and/or warnings (e.g., audible/acoustic, visual, light, display message, user interface, haptic alert, or a combination thereof) directed to one or more users or to one or more devices (e.g., appliances, mobile device, cooking appliance, etc.). Alarm 70 may alert continually until deactivated by the user and/or a certain predetermined parameter/condition of appliance 40/controller 42 is met. Such alarm 70 may be internal or external to cooking appliance 40 and coupled wirelessly to controller 42 in some embodiments.

In some embodiments, cooking appliance 40 may include a control lock or control lock feature 72. Cooking appliance 40 may be equipped with control lock feature 72 that may be used to prevent others from using the controls while locked and also to prevent inadvertent activations of controls while cleaning the appliance. Accordingly, control lock feature 72 may be configured between a locked configuration/mode and/or an unlocked configuration/mode. When in the locked configuration, the controls associated with cooking appliance 40, such as user control 50 (e.g., touch pads, buttons, display, etc.), or portions thereof, are locked from the operation by the user such that cooking appliance 40 may not be used or the operation may not be altered. When in the unlocked configuration, the controls associated with cooking appliance 40 may be able to be used and not be locked out to the user. In some embodiments, only portion of user control 50 may be locked out to the user. For example, while the oven control of cooking appliance 40 is locked out to the user, the cooktop control of cooking appliance 40 may not be locked out to the user. In some embodiments of the locked configuration, if any user control 50 is operated (e.g., intentionally and/or unintentionally), alarm 70 may be configured to generate an alert to the user. In some embodiments, the alert generated by alarm 70 may be different for the unlocked configuration and/or the locked configuration.

In some embodiments for a gas cooking system 41, one or more electromechanical gas valves 74 may be coupled to controller 42 to provide control of gas cooking system 41. Controller 42 may be configured in some embodiments to control electromechanical gas valve 74 proportionally in accordance with user control 50 and thereby control the output level of gas cooking elements. In some embodiments, electromechanical gas valve 74 may be a voice coil controlled modulating valve, a stepper motor controlled modulating valve, or an electronically-actuated plug type valve in various embodiments, or using other types of electrically-controllable variable valves as will be appreciated by those of ordinary skill in the art. It will be appreciated that electromechanical gas valve 74 may be coupled and/or controlled remotely from user control 50 in some embodiments.

Figure 3:
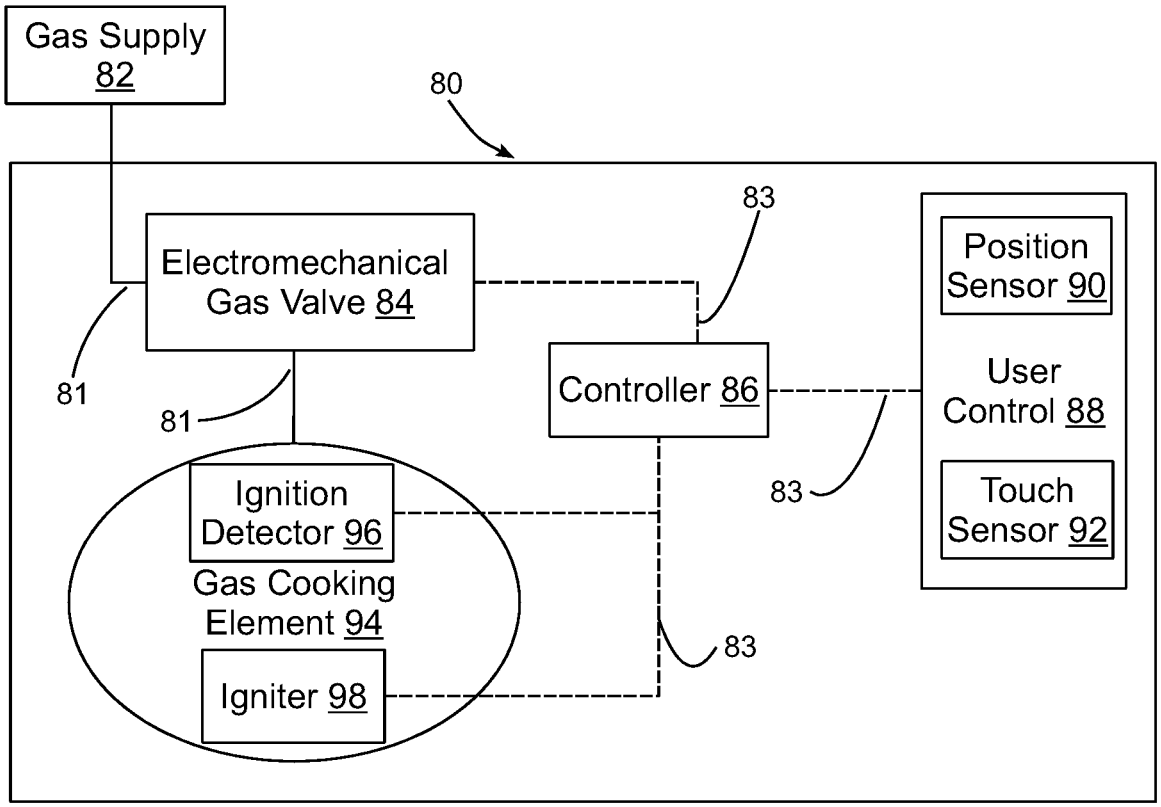
FIG. 3 is a block diagram of an example digital gas cooking system for a cooking appliance, in accordance with various embodiments.
Figure 4:
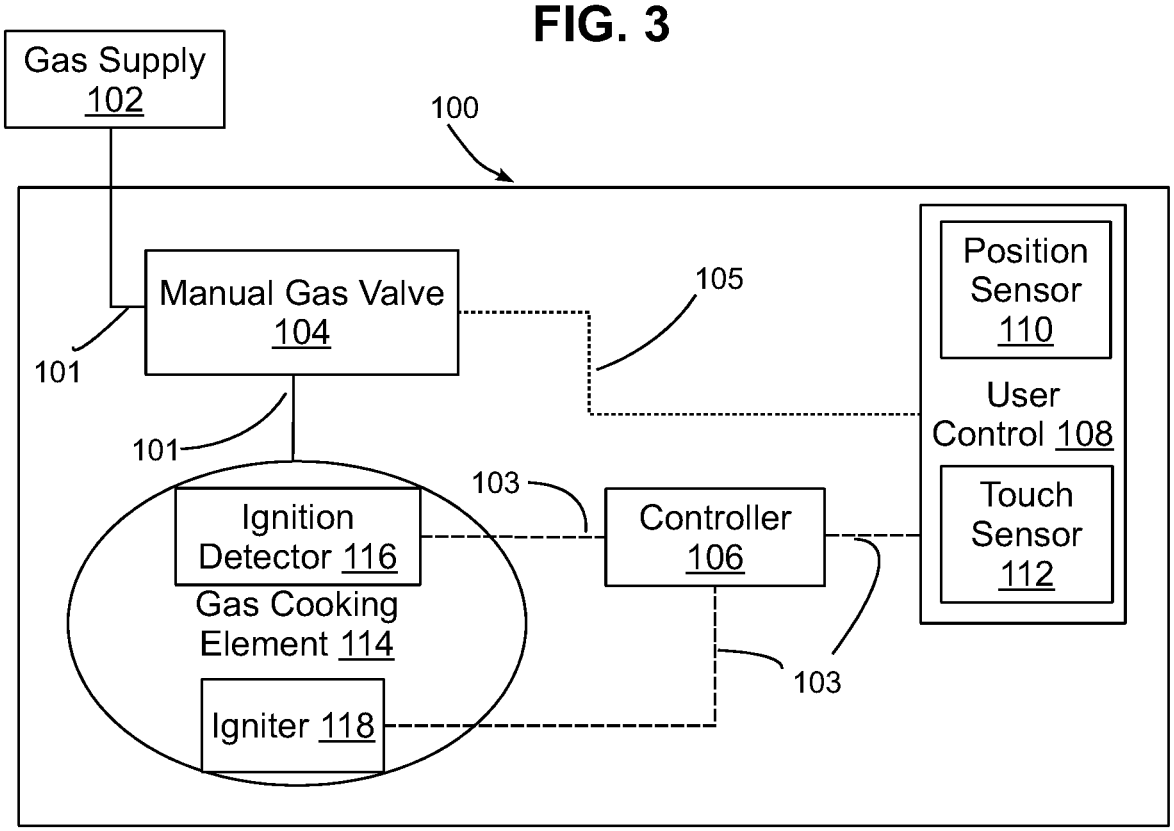
FIG. 4 is a block diagram of an example manual gas cooking system for a cooking appliance, in accordance with various embodiments.
Figure 5:
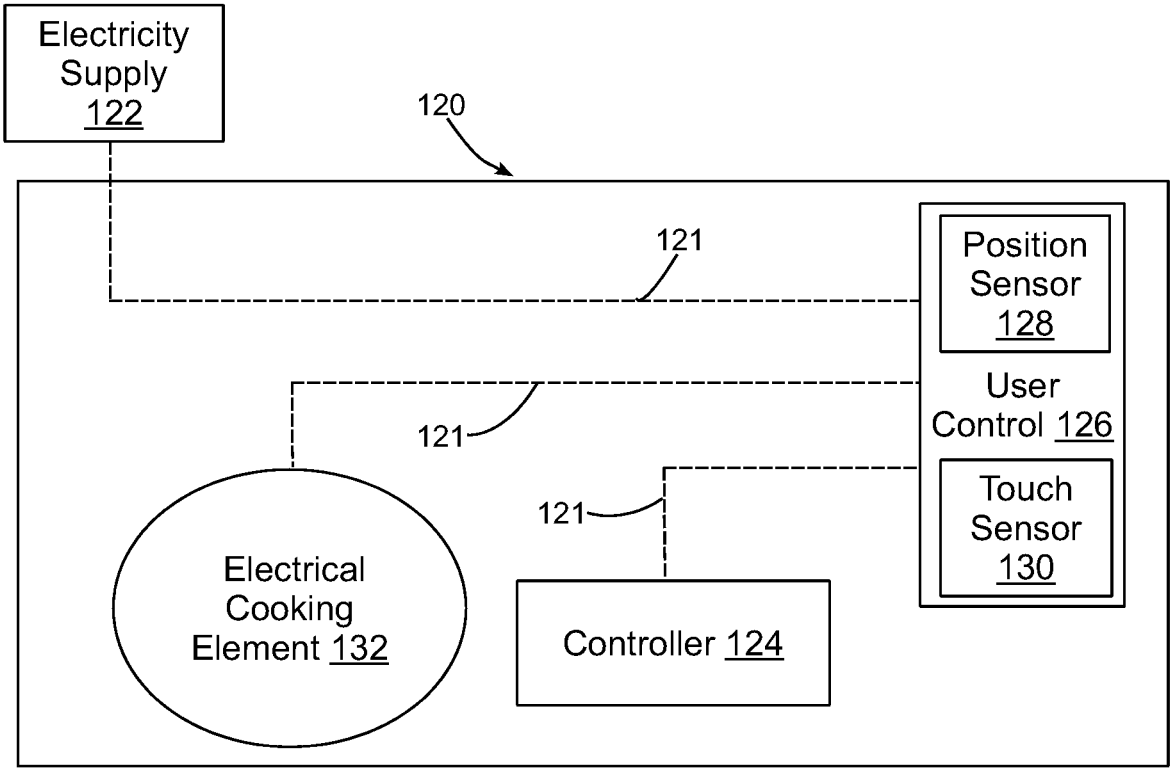
FIG. 5 a block diagram of an example electrical cooking system for a cooking appliance, in accordance with various embodiments.

In those embodiments for gas cooking system 41, one or more ignition detectors 76 may be coupled to controller 42 to detect the presence of heat and/or a flame for gas cooking elements as additional input for controlling cooking appliance 40. Ignition detector 76 may be a sensor designed to detect and respond to the presence of a flame or fire. In some embodiments, ignition detector 76 may include an infrared camera, infrared thermometer, thermal imaging camera, ultraviolet flame detector, flame ionization spectrometer, pyrometer, thermocouple, or flame sense rod. It will be appreciated that various technologies may be used for monitoring the flame, and the number and the location of ignition detector 76 are not limited. In some embodiments, such as illustrated in FIGS. 3-5 below, the number of ignition detectors 76 may correspond to the number of gas cooking elements; however, in other embodiments, the number of ignition detectors 76 may vary. For example, there may be only one ignition detector 76 for detecting the presence of a flame for all gas cooking elements simultaneously. Furthermore, although illustrated as positioned adjacent the gas cooking element in FIGS. 3-5, this is not intended to be limiting, as the one or more ignition detectors 76 may be positioned anywhere feasible for flame detection in the cooking appliance. In some embodiments, one or more igniters 78 may also be controlled by controller 42 for ignition of gas cooking elements of gas cooking system 41. Igniter 78 may be configured to create a spark to ignite gas supplied to gas cooking elements via gas valves.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the disclosure is not limited to the specific implementations discussed herein.

As noted above, one challenge associated with the operation of cooking appliances is the inadvertent operation of user controls. Embodiments consistent with the disclosure address this challenge in part by controlling a cooking appliance in response to a user touching status detected by a touch sensor integrated on the user control, a position status detected by a position sensor, and/or an ignition status detected by an ignition detector. For example, in some embodiments, when the position sensor detects a control knob being moved, a touch may also be sensed by one or more touch sensors on the control knob. Otherwise, an alert may be trigged to warn the user for the control knob movement. In addition, as will become more apparent below, this disclosure also provides a new touch sensing operation manner to activate and/or deactivate a control lock feature that simultaneously prevents intentional and/or unintentional operation and permits an energization of a cooking element in a multiple tap touch sensing operation manner. The disclosed touch sensing manners are not provided by traditional systems and apparatus.

Now turning to FIGS. 3-5, various embodiments of cooking system hardware environment directed to achieve the above objectives are illustrated in greater detail, including a digital gas system (FIG. 3), a manual gas system (FIG. 4) and an electrical system (FIG. 5). FIG. 3, for example, illustrates a digital gas system 80, where a gas cooking element 94 (e.g. a cooktop burner and/or oven burner), including an igniter 98 to ignite gas supplied thereto and an ignition detector 96 to detect an ignition status thereof, may be coupled to a gas, liquid, or fuel supply that is functionally represented by block 82 via a gas channel/tube 81 and a gas valve capable of regulating gas flow thereto. The gas valve may be implemented in some embodiments as a variable electronically-controlled electromechanical gas valve 84 coupled to a user control 88 through a controller 86 via an electrical connection 83. User control 88 may be configured to control an output level of gas cooking element 94 through movement within a range of positions to adjust the gas flow to electromechanical gas valve 84 within a gas flow range between a fully open state and a fully closed state for electromechanical gas valve 84 in some instances, or within a sub-range between the fully open state and the fully closed state in other instances. In some embodiments, user control 88 may include a position sensor 90 to detect a position status of user control 88 within the range of positions and a touch sensor 92 to detect a user touching status thereof.

FIG. 4 illustrates a manual gas system 100, where the gas valve may be implemented as a manual gas valve 104 in fluid communication between a gas supply 102 and a gas cooking element 114 via a gas channel/tube 101. Gas cooking element 114 may also include an igniter 118 to ignite gas supplied thereto from gas supply 102 and an ignition detector 116 to detect an ignition status thereof. Manual gas valve 104 may directly engage a user control 108 via a mechanical connection 105 instead of through a controller 106 via an electrical connection 103, which is different from digital gas system 80. In some embodiments, user control 108, including a position sensor 110 and a touch sensor 112, may be configured to control an output level of gas cooking elements 104 through movement within a range of positions to adjust the gas flow to manual gas valve 104 within a gas flow range or a sub range of manual gas valve 104.

FIG. 5 illustrates an electrical system 120, where an output level of an electrical cooking element 132 may be configured to be adjusted through adjusting the electricity supplied from an electricity supply 122 to electrical cooking element 132 via an electrical connection 121. In some embodiments, the adjustment may be achieved through movement within a range of positions of a user control 126 (e.g., a potentiometer or other variable resistance) coupled to a controller 124 via electrical connection 121. Furthermore, in some instances, an infinite switch configuration may be used where user control 126 is hard wired to electrical cooking element 132 such that controller 124 lacks direct control over the on/off state of the electrical cooking element.

In some embodiments, user control 126 may include a position sensor 128 and a touch sensor 130 to detect a position status within the range of positions and a touching status thereof. In the illustrated embodiments, each different types of systems may include various sensing components (e.g., touch sensors, position sensors, ignition detectors, etc.) coupled to the controller configured to achieved the desired features (e.g., selectively generate an alert, activate and/or deactivate certain features, etc.) in response to the signals detected by those various sensing components. It will be appreciated that numerous variations and modifications to the cooking systems illustrated in FIGS. 3-5 will be apparent to one of ordinary skill in the art, as will become apparent from the description below. Therefore, the disclosure is not limited to the specific implementations discussed herein.

Figure 6:
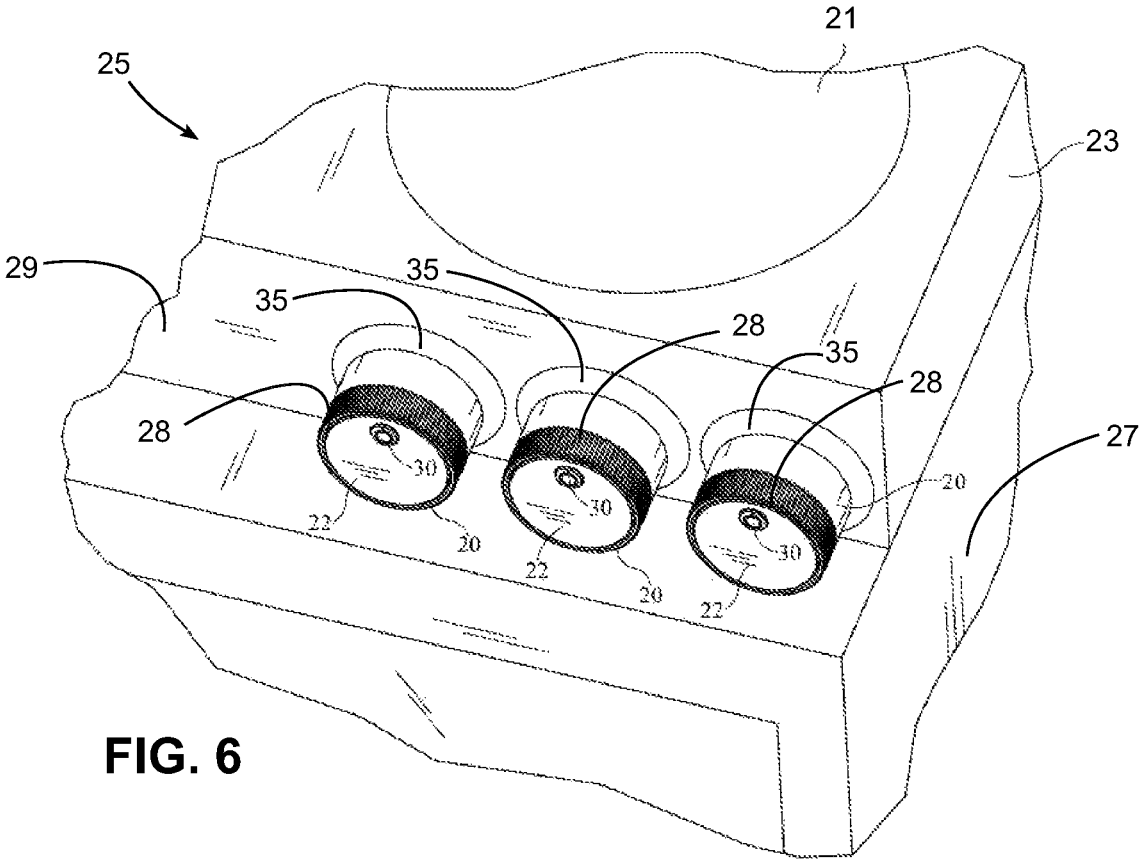
FIG. 6 is an enlarged portion view of a cooking appliance illustrating one or more control knobs having one or more integrated touch sensors, in accordance with various embodiments.

The hardware systems described above may be combined with embodiments as shown in FIGS. 6-9 to implement the desired features. FIG. 6, for example, illustrates a portion of a cooking appliance 25 including a cooktop 23 on a top of a housing 27 with one or more rotatable control knobs 20 (e.g., mechanical/electrical control knobs or controls), each having a rotatable ring 28 and a separate touch sensor 30 (e.g., a separate touch-sensitive button, a switch interface, etc.) disposed on a stationary front face or surface 22 thereof. Cooktop 23 may include one or more cooktop burners 21 corresponding to the one or more control knobs 20. Control knob 20 for controlling cooktop burner 21 may be located on a control panel 29 at the front of cook top 23 and used to energize and/or select an output level of cooktop burner 21 within a range of positions as indicated as the position labels of FIG. 7 in some embodiments.

It will be appreciated that control knob 20 may be a variety of constructions, quantities, shapes, sizes, and positions disposed on cooking appliance 25. In some embodiments, control knob 20 may be implemented as another type of rotary and/or variable control, and thus which may also be referred to herein as control knob 20, though the disclosure is not limited to the use of a rotary or variable control for control knob 20. Other configurations, e.g., sliders, combinations of buttons or switches assigning different output levels, or other controls or combinations of controls capable of selecting from among a plurality of output levels for a particular burner 21 or group of burners 21 assigned thereto at a particular time may be used for control knob 20 in other embodiments. It will be appreciated that additional controls and/or knobs may be utilized in cooking appliance 25, and touch sensor 30 thereon may be any suitable touch element as noted above. It will also be appreciated that the location of touch sensor 30 on control knob 20 is not limited. For example, touch sensor 30 may be located at a control knob trim plate 35. In some other embodiments, touch sensor 30 may be disposed on anywhere of appliance itself (e.g., housing, cook top, control panel, etc.) in a variety of positions. For example, in some embodiments, one or more touch sensors may be located on control panel 29 and be separate/spaced from the control knob 30.

Figure 8:
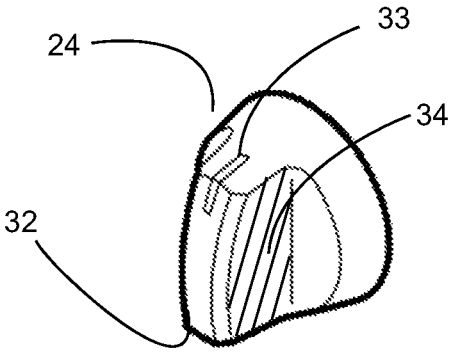
FIGS. 8-9 are enlarged perspective views illustrating different configurations of control knobs having one or more integrated touch sensors, in accordance with various embodiments.
Figure 9:
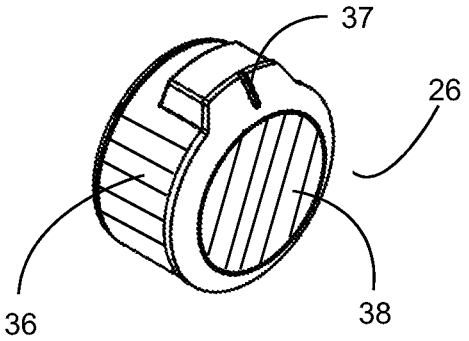

As noted above, control knob 20 may be integrated with touch sensor 30 for detecting a user touching status of control knob 20 via touching, selecting, depressing, or otherwise contacting or choosing by a user to achieve the desired features. In some embodiments, touch sensor 30 may be a capacitive sensor covering an entirety of control knob 20. FIGS. 8 and 9 illustrate various additional configurations for control knob 20 and touch sensor 30 that may be used in various embodiments. For example, control knobs 24, 26, each being configured as a rotatable knob, may include one or more designated portions/areas implemented as touch sensors that may be actuated responsive to touching and/or pushing in/depressing on the surface. As shown in FIG. 8, control knob 24 may be a blade knob and include a first touch sensor 32 and a second touch sensor 34 located on designated portions of blade knob 24. In some embodiments, for example, first touch sensor 32 and second touch sensor 34 may be located on two opposite sides of a blade portion of the blade knob 24 for grasping by the user. In some other embodiments as shown in FIG. 9, a first touch senor 36 may be located on a designated portion circumscribing an outer periphery of control knob 26 for grasping by the user, and a second touch sensor 38 may be located on a front face surface area of control knob 26. In some embodiments, rotatable ring 28 in FIG. 6 may also be a second touch senor for control knob 20 with touch sensor 30 being a first touch sensor.

Various features may be achieved with integrated touch sensing controls. In some embodiments, the integrated touch sensor may be used to alert the user with an unintentional rotation of the user control. For example, as shown in FIG. 6, touch sensor 30 may be an electromechanical switch that is actuated responsive to pushing in or depressing so that a user must push in or click touch sensor 30 while rotating control knob 20 to energize and/or select an output level for cooktop burner 21 by rotating control knob 20 to avoid triggering an alert. When touch sensor 30 is not activated, rotating (e.g., unintentionally and/or intentionally) control knob 20 may trigger the alert. This may happen when control knob 20 is unintentionally moved (e.g., by a jumping pet or a playing child). In such embodiments, activating touch sensor 30 may indicate that the user intends and is ready to energize cooktop burner 21.

In some embodiments, besides generating alerts, the controller of cooking appliance 25 may also be configured to disable the energization of cooktop burner 21 if touch sensor 30 is not activated when control knob 20 has moved to an energization position. It will be appreciated that for gas cooking systems, e.g., manual gas systems, the igniter may still be allowed to operate to lite the gas flow with an unintentional movement of control knob 20, while the alert may be persistent until deactivated by the user. In digital gas systems, on the other hand, energization of the cooktop burner may be disabled. In some embodiments of electrical systems, cooktop burner 21 may still be energized with an unintentional movement of control knob 20, while the alert may be persistent until deactivated by the user.

In those embodiments with at least two touch sensors disposed on a user control as shown in FIGS. 8 and 9, each of first touch sensors 32, 36 may be configured to detect a first user touching status, and each of second touch sensors 34, 38 may be configured to detect a second user touching status. In some embodiments, both first and second touch sensors may be coupled to the controller and configured to generate an alert when the position sensor indicates the control knob has moved to an energized position without both of the first and second user touching sensors detecting touches. It will be appreciated that the designated touch sensing portions and/or touch sensors may be positioned in a manner that are only touched concurrently when the user intentionally uses the control knob and are unlikely to be touched concurrently under unintentional situations.

To further minimize the risk of unintentional energization, in some embodiments, energization of a cooking element may be enabled in response to sensing a multiple tap gesture on an integrated touch sensor. For example, the user may be required to double tap on touch sensor 30 before rotating control knob 20 for energization. In such embodiments, any rotation of control knob 20 out of the OFF position without first enabling with the double-tap gesture may generate an alert. In some embodiments, after the first tap has been detected, energization may be enabled in response to sensing the second tap within a predetermined period of time (e.g., two seconds). For example, the user may need to touch/press touch sensor 30 twice in two seconds to enable energization of cooktop burner 21. Without sensing the second tap by touch sensor 30 within two seconds, cooktop burner 21 may not be able to be energized. It will be appreciated that in some embodiments, without touching and/or multiple tapping touch sensor 30 to indicate the rotation as intentional, energization of the burner may be disabled.

Figure 7:
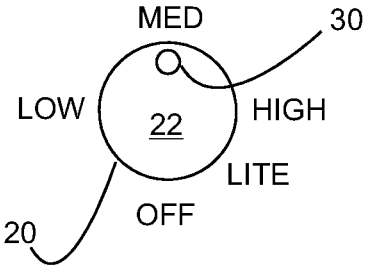
FIG. 7 is an enlarged front view of a control knob of FIG. 6 for a gas cooking system, in accordance with various embodiments.

In some embodiments, cooktop burner 21 may be a gas burner. Different from an electrical burner, a gas burner has an ignition process at the beginning of a cooking operation to lite the burner with flame for heating. As shown in FIG. 7, an ignition process of cooktop burner 21 may be performed by rotating control knob 20 counter-clockwise from "OFF" position to an "LITE" position (i.e., a sparking range between "OFF" and "HIGH") to activate an igniter to create sparks to ignite the gas flow. It will be appreciated that the illustration in FIG. 7 is not limited, and control knob 20 for digital gas systems may be rotated in either direction (i.e., clockwise for ignition). If the ignition process is successful, the user may continue rotating control knob 20 to a position within a range of positions corresponding to a gas valve position for a desired gas flow rate and corresponding output level of cooktop burner 21. However, the user may rotate control knob 20 past the sparking range too fast to ignite the burner 21, and the user may release control knob 20 beyond the sparking range as the user may be unaware of the unsuccessful ignition process. To avoid this issue, the controller of gas cooking appliance may be configured to remind the user to maintain contact with the user control until ignition of the corresponding cooking element is achieved and verified by an ignition detector. For example, while the user is rotating control knob 20 with touch sensed by touch sensor 30 to ignite burner 21, an alert may be generated once the flame is detected to inform the user of the successful ignition process, and the user may choose to release or continue rotating control knob 20 within the operating range (the range between the "HIGH" and "LOW" as shown in FIG. 7). In some additional embodiments, if the touch on the user control is no longer sensed before the ignition detector senses the flame, then an alert may also be generated to notify the user that the ignition process is not successful and the gas valve remains in an open position in which gas is currently flowing to the gas cooking element. For example, if the user releases control knob 20 with no touch sensed by touch sensor 30 and no flame in cooktop burner 21 detected by the ignition detector, an alert may be generated to remind the user. This is a helpful feature when viewing the flame of the cooking element is difficult due to obstructions like griddles and large cooking utensils. With the alert, the user could know whether it is the right time to move the user control out of the sparking range and into the operating range.

Besides a conventional sound alert, in some embodiments, the alert may be a haptic alert (e.g., a vibration on control knob 20). In some embodiments, the alert may be a visual alert (e.g., flashing lights through indicators 33, 37 of control knobs 24, 26) In some embodiments, the alert may be time delayed by a timer or time span (e.g., one second, two seconds, etc.) from the time of burner energization to avoid nuisance alerts. For example, with a delay, the alert may not be activated when someone (e.g., a user) bumps control knob 20 inadvertently and immediately rotates control knob 20 back to the off position.

When the alert has been triggered under different scenarios as noted above, the user may deactivate the alert in different manners. For example, in some embodiments, deactivation of the alert may be in response to control knob 20 being rotated back to the off position. In some other embodiments, activating touch sensor 30 may deactivate the alert. Alternatively or in addition to the herein described actions, a variety of other user actions or appliance conditions may deactivate the alert.

In some embodiments, the user may activate at least two integrated touch sensors on at least two user controls to activate and/or deactivate a control lock feature as noted above. For example, as shown in FIG. 6, cooking appliance 25 may include a plurality of cooktop burners 21 with a plurality of control knobs 20, each having touch sensor 30 disposed thereon and configured to detect a user touching status therefor. In such embodiments, the user may touch two or more touch sensors 30 on separate control knobs 20 at the same time to activate and/or deactivate a control lock feature. In some embodiments, the at least two integrated touch sensors on the at least two user controls may need to be touched by the user for a predetermined period of time to activate and/or deactivate the control lock feature. For example, the control lock feature may be activated and/or deactivated by touching two or more touch sensors 30 for five seconds at the same time.

Figure 10:
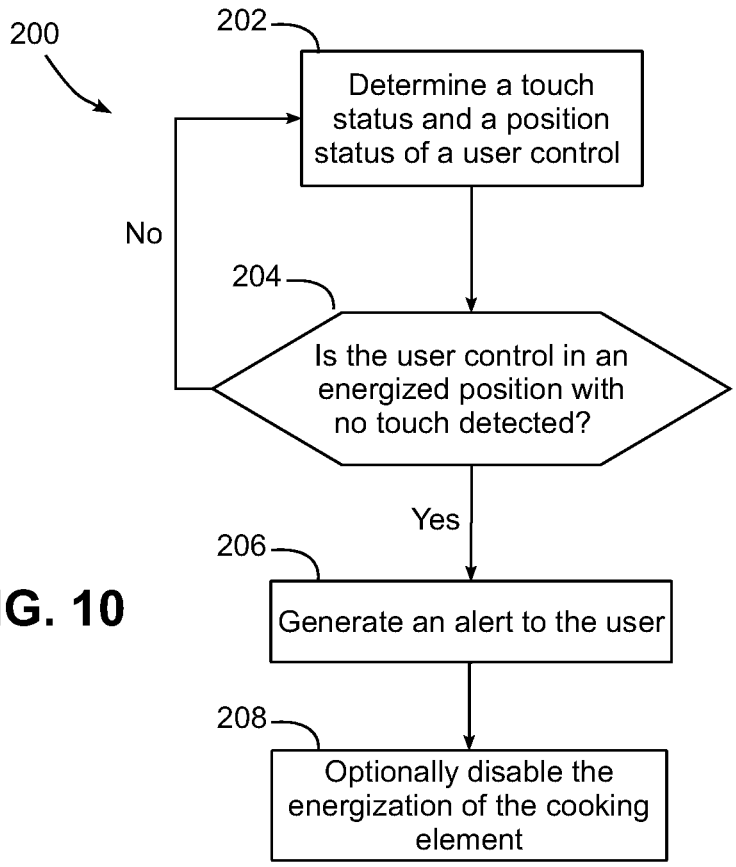

Now turning to FIGS. 10-14, these figures illustrate various sequences of operations for performing integrated touch sensing operations in cooking appliances consistent with some embodiments of the disclosure. As shown in FIG. 10, a sequence 200 begins in block 202 by determining a touch status and a position status of a user control, e.g., by detecting the touch status and position status of user control 88 through touch sensor 92 and position sensor 90 integrated with user control 88 as shown in FIG. 3. Next, in block 204, based on the input from the touch sensor and the position sensor, if the user control is in an energized position with no touch detected, an alert may be generated to remind the user in block 206. In some instances, this decision may be based upon whether touch is detected during detection of a change in position of the user control (i.e., when actual movement of the control is detected). If the user control is not moved to an energized position or is in an energization position with touch detected, block 206 passes control back to block 202 to restart the sequence 200. In some embodiments, the energization of the corresponding cooking element may be optionally disabled in block 208 following the alert in block 206.

Figure 11:
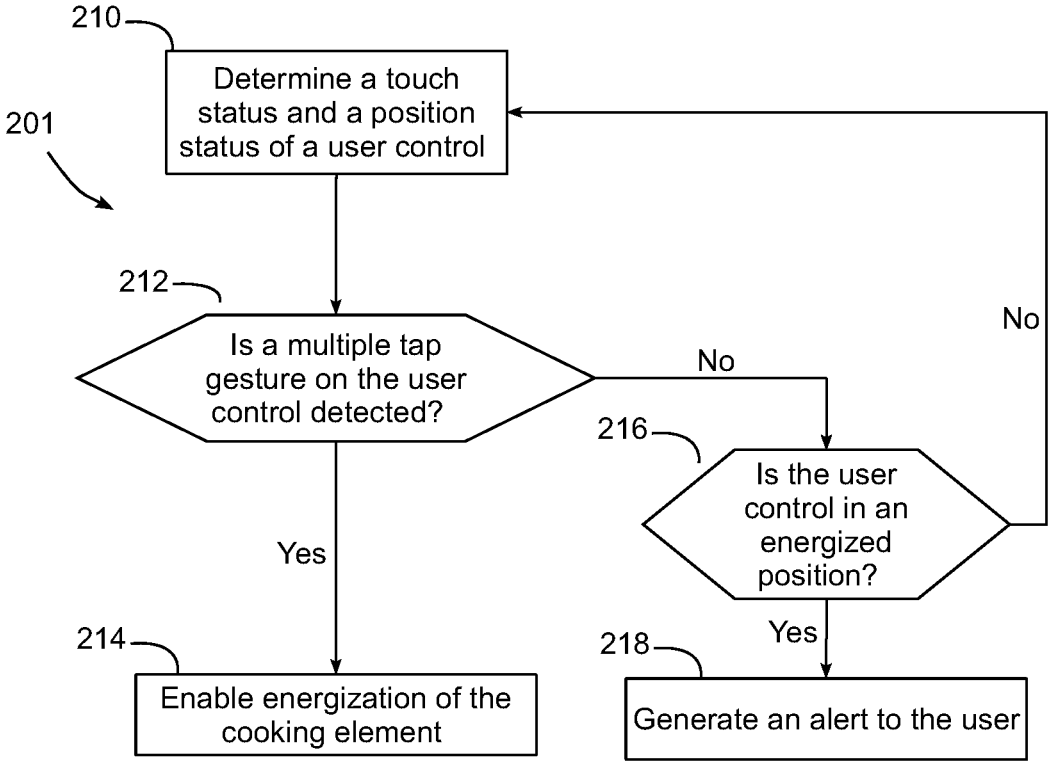

In some embodiments, as shown in FIG. 11, a different sequence 201 starts in block 210 by determining a touch status and a position status of a user control. Then, block 212 determines whether a multiple tap gesture on the user control has been detected. If the multiple tap gesture is detected, an energization of the corresponding cooking element is enabled in block 214. If the multiple tap gesture is not detected, block 216 determines whether the user control is in an energized position or not, and an alert may be generated in block 218 if the user control is in an energized position. If neither an energization position of the user control nor a multiple tap gesture on the user control is detected, block 206 passes control back to block 210 to restart the sequence 201.

Figure 12:
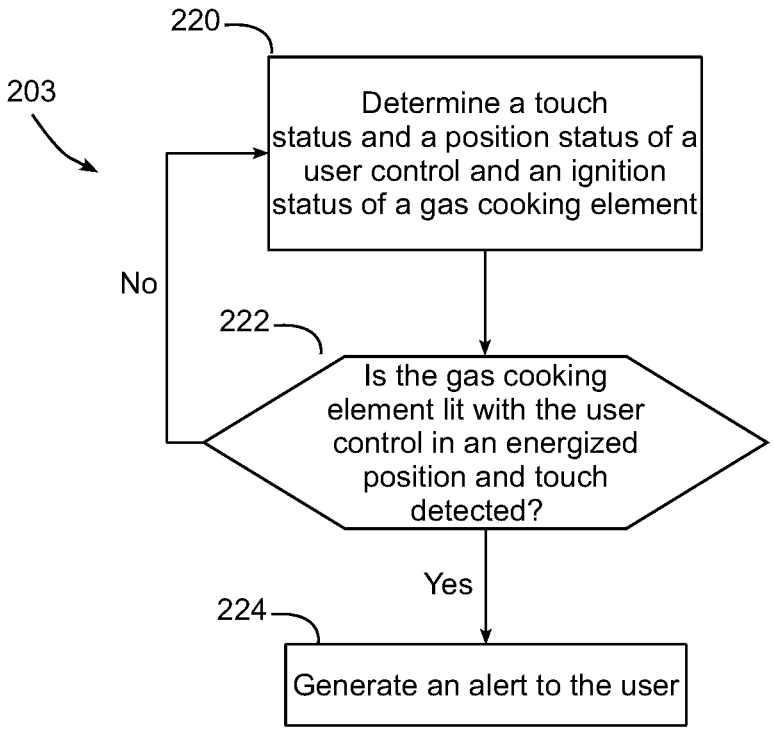
Figure 13:
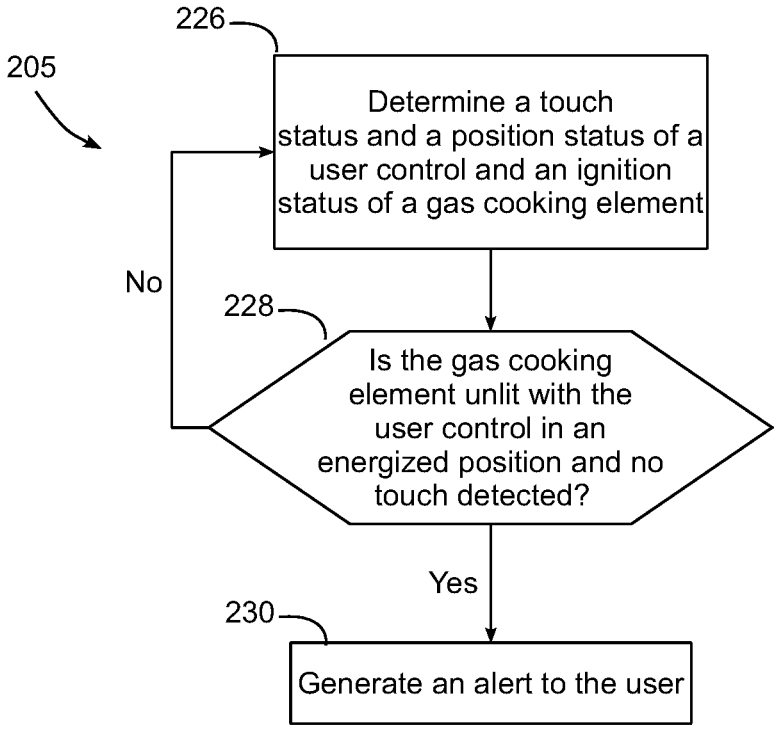

In some other embodiments as shown in FIGS. 12 and 13, operation sequences 203 and 205 may be used for gas systems to generate alerts during the ignition process. The sequence 203 of FIG. 12 starts by determining a touch status and a position status of a user control and an ignition status of a gas cooking elements in block 220. If the determination in block 222 is the gas cooking element is lit with the user control in an energized position and touch detected, an alert may be generated in block 224. If the above determination in block 222 is not satisfied, block 222 passes control back to block 220 to restart the sequence 203. Similarly, the sequence 205 of FIG. 13 starts by determining a touch status and a position status of a user control and an ignition status of a gas cooking elements in block 226. If the determination in block 228 is the gas cooking element is unlit with the user control in an energized position and no touch detected, an alert may be generated in block 230. If the above determination in block 228 is not satisfied, control passes back to block 226 to restart the sequence 205.

Figure 14:
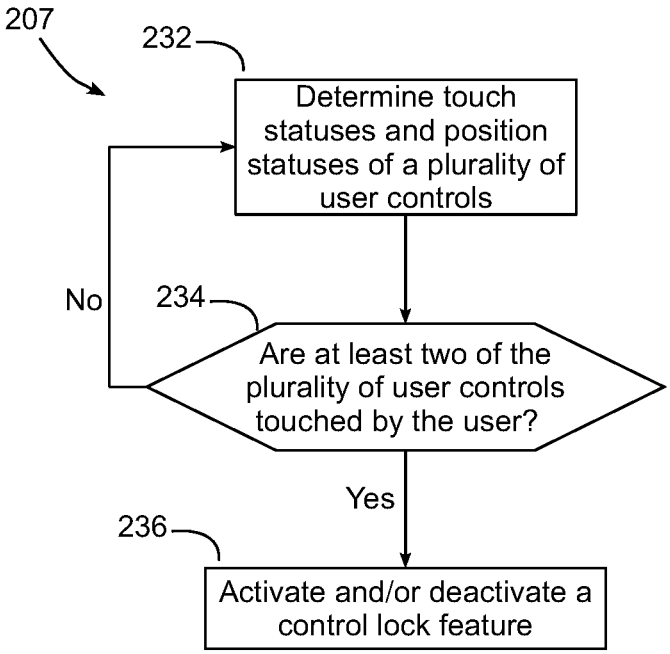
FIGS. 10-14 are flowcharts illustrating example control sequences of operations for cooking appliances, in accordance with various embodiments.

In yet some other embodiments as shown in FIG. 14, a control lock feature sequence 207 may be performed. The sequence 207 starts by determining touch states and position states of a plurality of user controls in block 232, and block 234 determines whether at least two of the plurality of user controls are touched by the user or not. If the answer is yes, a control lock feature is activated and/or deactivated in block 236. If the answer is no, control passes back to block 232 to restart the sequence 207.

It will be appreciated that the various features described in FIGS. 10-14 may be implemented separately in a cooking appliance design in some embodiments, while in other embodiments, multiple of such features may be implemented in the same cooking appliance design. Further, the logic used to implement such features may be combined in some embodiments such that multiple features are monitored by the same logic. In addition, in some embodiments the current cooking state may also be used in the aforementioned alert detection algorithms, e.g., such that once a successful ignition of a burner has been detected such that it can also be determined that active cooking is in progress, certain alerts, e.g., due to the lack of touching of a control when the control is in an energized position, may be disabled.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

"Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A cooking appliance, comprising:

a cooking element;

a user control configured to control an output level of the cooking element through movement of the user control within a range of positions;

a touch sensor disposed on the user control and configured to detect a user touching status of the user control;

a position sensor configured to detect a position status of the user control within the range of positions; and a controller coupled to the touch sensor and the position sensor and configured to selectively generate an alert for a user in response to the user touching status detected by the touch sensor and the position status detected by the position sensor.

2. The cooking appliance of claim 1, wherein the controller is further configured to generate the alert in response to determining that the user touching status indicates that the user control is not currently being touched by the user and that the position status indicates that the user control has moved to an energized position within the range of the positions.

3. The cooking appliance of claim 2, wherein the controller is further configured to disable energization of the cooking element in response to determining that the user touching status indicates that the user control is not currently being touched by the user and that the position status indicates that the user control has moved to the energized position within the range of the positions.

4. The cooking appliance of claim 2, wherein the touch sensor is a first touch sensor and the user touching status is a first user touching status, wherein the cooking appliance further comprises a second touch sensor disposed on the user control and configured to detect a second user touching status of the user control, and wherein the controller is further coupled to the second touch sensor and is configured to generate the alert in response to determining that the position status indicates that the user control has moved to an energized position within the range of the positions without both of the first and second user touching statuses indicating that the user control is currently being touched by the user.

5. The cooking appliance of claim 4, wherein the user control is a blade knob, and the first and the second touch sensors are located on two opposite sides of a blade portion of the blade knob for grasping by the user.

6. The cooking appliance of claim 1, wherein the controller is further configured to enable energization of the cooking element in response to detecting a multi-tap gesture by the user from the user touching status.

7. The cooking appliance of claim 6, wherein the controller determines the multi-tap gesture by the user from the user touching status by detecting multiple user touches on the touch sensor within a predetermined period of time.

8. The cooking appliance of claim 6, wherein the controller is further configured to generate the alert in response to determining that the position status indicates that the user control has moved to an energized position within the range of the positions without first detecting the multi-tap gesture by the user from the user touching status.

9. The cooking appliance of claim 1, wherein the alert for the user includes a sound alert, a visual alert, or a haptic alert.

10. The cooking appliance of claim 1, wherein the touch sensor includes a capacitive sensor, a mechanical switch, or an electromechanical switch.

11. The cooking appliance of claim 1, wherein the touch sensor is a capacitive sensor covering an entirety of the user control.

12. The cooking appliance of claim 1, wherein the touch sensor is located at a designated portion of the user control.

13. The cooking appliance of claim 12, wherein the designated portion circumscribes an outer periphery of the user control for grasping by the user.

14. The cooking appliance of claim 1, when the position sensor includes an encoder.

15. The cooking appliance of claim 1, wherein the cooking element is a gas cooking element.

16. The cooking appliance of claim 15, further comprising a gas valve configured to regulate gas flow to the gas cooking element, wherein the user control is mechanically coupled to the gas valve.

17. The cooking appliance of claim 1, further comprising an ignition detector configured to detect an ignition status of the cooking element, wherein the controller is coupled to the touch sensor, the ignition detector, and the position sensor and is configured to selectively generate a second alert for a user in response to the user touching status detected by the touch sensor, the ignition status detected by the ignition detector, and the position status detected by the position sensor.

18. The cooking appliance of claim 1, further comprising a second cooking element, a second user control configured to control a second output level of the second cooking element through movement of the second user control within a second range of positions, and a second touch sensor disposed on the second user control and configured to detect a second user touching status of the second user control, wherein the controller is further coupled to the second touch sensor of the second user control and is configured to activate and/or deactivate a control lock function in response to determining that the touching status and the second user touching status of the touch sensor and the second touch sensor of the user control and the second user control indicate that the user control and the second user control are currently being touched by the user.

19. A gas cooking appliance, comprising:

a gas cooking element;

a user control configured to control an output level of the gas cooking element through movement of the user control within a range of positions;

a touch sensor disposed on the user control and configured to detect a user touching status of the user control;

an ignition detector configured to detect a presence of heat and/or a flame associated with an ignition status of the gas cooking element;

a position sensor configured to detect a position status of the user control within the range of positions; and a controller coupled to the touch sensor, the ignition detector, and the position sensor and configured to selectively generate an alert for a user in response to the user touching status detected by the touch sensor, the ignition status detected by the ignition detector, and the position status detected by the position sensor.

20. The gas cooking appliance of claim 19, wherein the controller is configured to generate the alert in response to determining that the user touching status indicates that the user control is currently being touched by the user and that the ignition status indicates that the gas cooking element is currently lit.

21. The gas cooking appliance of claim 19, wherein the controller is configured to generate the alert in response to determining that the user touching status indicates that the user control is not currently being touched by the user, that the ignition status indicates that the gas cooking element is not currently lit, and that the position status indicates that the user control is in a position in which gas is currently flowing to the gas cooking element.

22. The gas cooking appliance of claim 19, wherein the ignition detector includes a thermocouple, a flame sensor, or a vision sensor.

23. A cooking appliance, comprising:

a plurality of cooking elements;

a plurality of user controls configured to control output levels of the plurality of cooking elements, each of which having a touch sensor disposed thereon and configured to detect a user touching status therefor; and a controller coupled to the touch sensor of each of the plurality of user controls and configured to activate and/or deactivate a control lock function in response to determining that the user touching statuses of the touch sensors of at least two of the plurality of user controls indicate that the at least two of the plurality of user controls are currently and simultaneously being touched by a user.

24. The cooking appliance of claim 23, wherein the controller is configured to activate and/or deactivate the control lock function only if at least two of the plurality of user controls are currently being touched by a user for a predetermined period of time.

* * * * *